US008756849B2

(12) United States Patent
Troy

(10) Patent No.: US 8,756,849 B2
(45) Date of Patent: Jun. 24, 2014

(54) REINFORCED EXTENDABLE BUTT STOCK

(75) Inventor: Stephen P. Troy, Lee, MA (US)

(73) Assignee: Troy Industries, Inc., West Springfield, MA (US)

( * ) Notice: Subject to any disclaimer, the term of this patent is extended or adjusted under 35 U.S.C. 154(b) by 377 days.

(21) Appl. No.: 13/007,738

(22) Filed: Jan. 17, 2011

(65) Prior Publication Data

US 2011/0192067 A1 Aug. 11, 2011

Related U.S. Application Data

(60) Provisional application No. 61/295,583, filed on Jan. 18, 2010.

(51) Int. Cl.
*F41C 23/00* (2006.01)

(52) U.S. Cl.
USPC ..... 42/73; 42/71.01

(58) Field of Classification Search
USPC ..... 42/73, 71.01
See application file for complete search history.

(56) References Cited

U.S. PATENT DOCUMENTS

| | | | | |
|---|---|---|---|---|
| 7,984,580 | B1 * | 7/2011 | Giauque et al. | 42/73 |
| 8,387,298 | B2 * | 3/2013 | Kincel | 42/74 |
| 2007/0261284 | A1 * | 11/2007 | Keng | 42/73 |

* cited by examiner

*Primary Examiner* — J. Woodrow Eldred

(74) *Attorney, Agent, or Firm* — Parsons & Goltry; Robert A. Parsons; Michael W. Goltry

(57) ABSTRACT

An extendable butt stock includes a housing having a forward end, an open rearward end, an opening at the forward end and a buffer tube of a firearm received therethrough. A hinge plate pivotally attaches a butt plate to the rearward end of the housing, movable between an open position and a closed position. A spine reinforcing member having a rearward end and a forward end extends from the rearward end of the housing to proximate the forward end of the housing and cradles the buffer tube. The butt plate contacts the rearward end of the spine reinforcing member when the butt plate is in the closed position. An engagement mechanism is carried by the housing and releasably attaches the buffer tube to the spine reinforcing member.

14 Claims, 4 Drawing Sheets

REINFORCED EXTENDABLE BUTT STOCK

CROSS-REFERENCE TO RELATED APPLICATION

This application claims the benefit of U.S. Provisional Application No. 61/295,983, filed 18 Jan. 2010.

FIELD OF THE INVENTION

This invention relates to firearm accessories.

More particularly, the present invention relates to butt stocks for firearms.

BACKGROUND OF THE INVENTION

In the field of firearms, butt stocks are numerous and varied. More and more, butt stocks are becoming increasingly adjustable and lighter in weight. Weight of firearms is very important to individuals carrying them for extended periods of time. Thus, very lightweight materials such as plastic are increasingly being used. While effective in reducing weight, lightweight materials are often fragile and have poor impact strength. This can be a problem since butt stocks have traditionally been used as a striking tool. For example, butt stocks of firearms have traditionally been used to break open doors, crates, and the like. Currently, new lightweight butt stocks will not survive this application and will not be effective in this use. A damaged butt stock is very detrimental to the functioning of the firearm.

It would be highly advantageous, therefore, to remedy the foregoing and other deficiencies inherent in the prior art.

SUMMARY OF THE INVENTION

Briefly, to achieve the desired objects and advantages of the instant invention, provided is an extendable butt stock including a housing having a forward end, a rearward end, an upper portion being open at the forward end for receiving a buffer tube of a firearm therein, and a lower portion separated from the upper portion by a divider extending substantially from the rearward end to the forward end. A spine reinforcing member having a rearward end and a forward end is carried within the upper portion by the divider. An engagement mechanism is carried by the housing for attaching a buffer tube of a firearm to the spine reinforcing member.

In another aspect, provided is an extendable butt stock including a housing having a forward end, an open rearward end, and an opening at the forward end for receiving a buffer tube of a firearm therethrough. A hinge plate pivotally attaches a butt plate to the rearward end of the housing. The butt plate is movable between an open position and a closed position. A spine reinforcing member having a rearward end and a forward end extends from the rearward end of the housing to proximate the forward end of the housing. The butt plate contacts the rearward end of the spine reinforcing member when the butt plate is in the closed position. An engagement mechanism is carried by the housing for attaching a buffer tube of a firearm to the spine reinforcing member.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
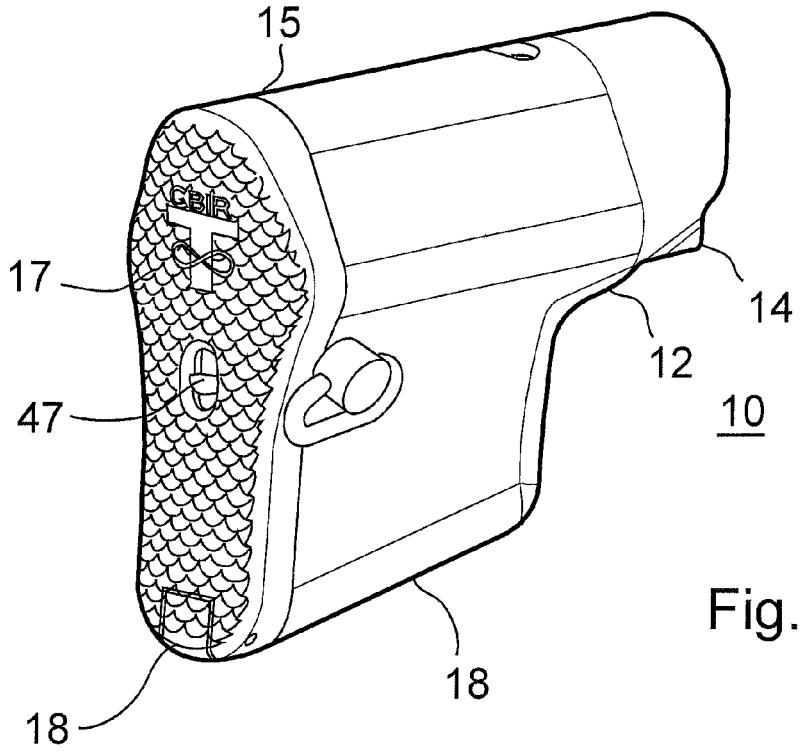
FIG. 1 is a perspective view of a butt stock according to the present invention.
Figure 2:
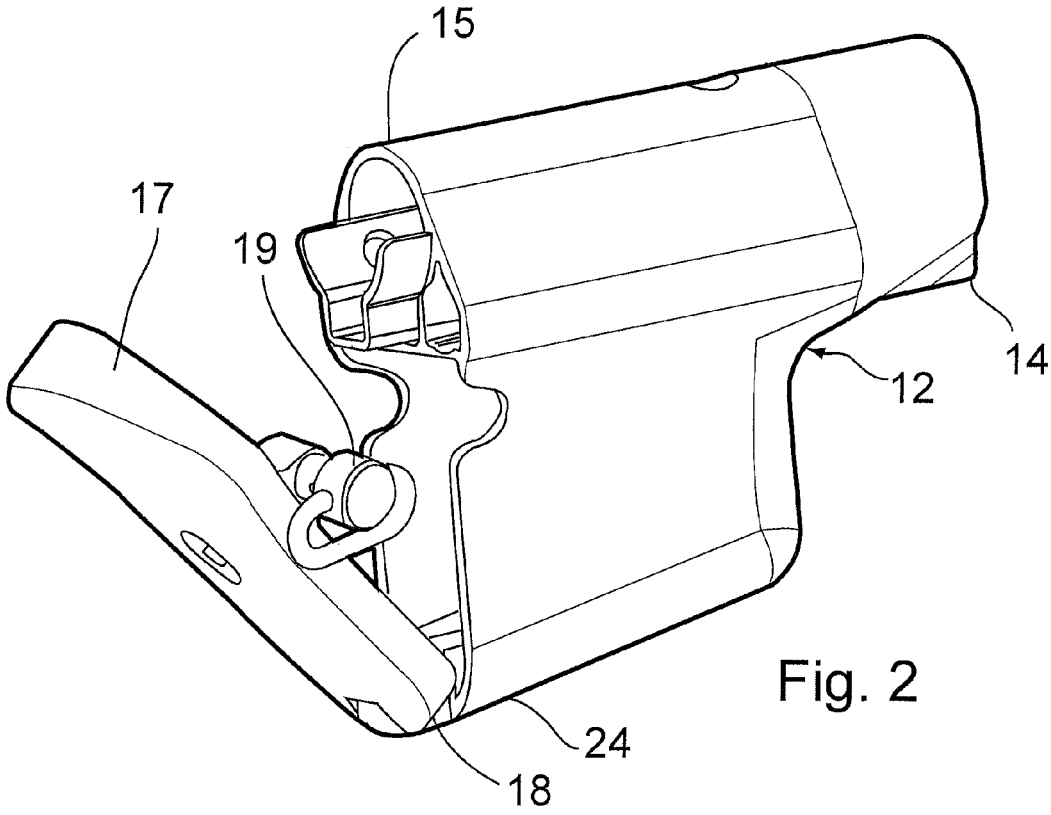
FIG. 2 is a perspective view of the butt stock of FIG. 1 with the butt plate moved toward an open position.

Turning now to the drawings in which like reference characters indicate corresponding elements throughout the several views, attention is first directed to FIGS. 1 and 2 which illustrate an extendable butt stock generally designated 10. Butt stock 10 is couplable to a firearm by receiving and retaining a buffer tube found on firearms as will be described presently. Butt stock 10 includes a housing 12 having a forward end 14 and a rearward end 15. Housing 12 is preferably formed of a lightweight rigid material such as plastic and the like. A butt plate 17 is pivotally attached to rearward end 15 by a hinge plate 18 carried at a bottom thereof and movable between an open position (FIG. 2) and a closed position (FIG. 1). With additional reference to FIG. 2, a top end of butt plate 18 is shown pivoted rearwardly toward the open position. Quick release swivels 19 are attached to butt plate 17 and are received by notches formed in the rearward end of housing 12 with butt plate 17 in the closed position.

Figure 3:
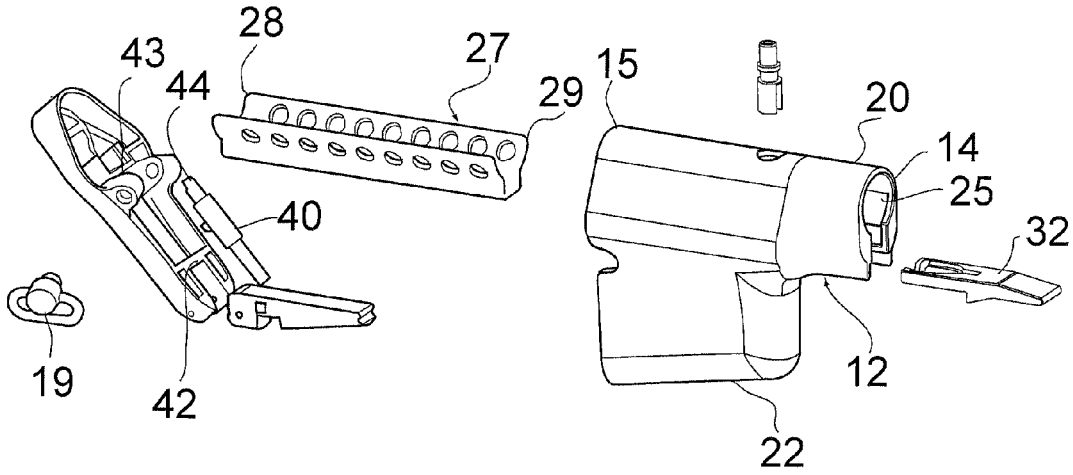
FIG. 3 is an exploded perspective view of the butt stock.
Figure 4:
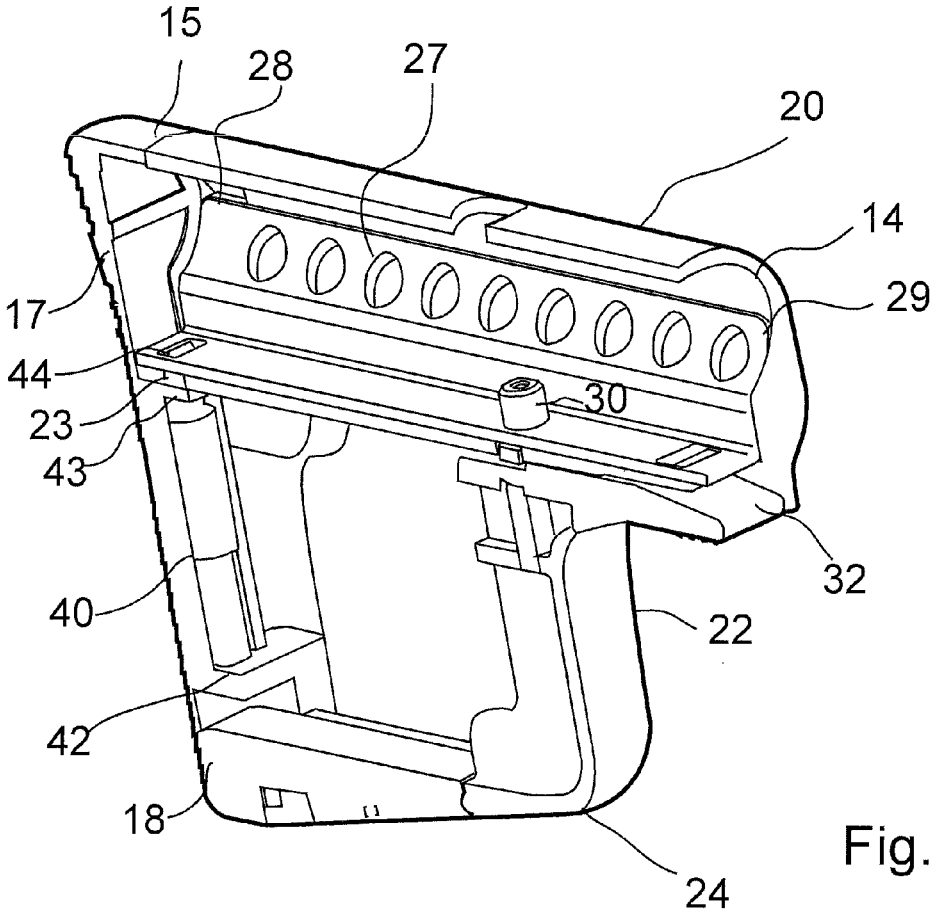
FIG. 4 is a sectional side view of the butt stock in the closed position.
Figure 5:
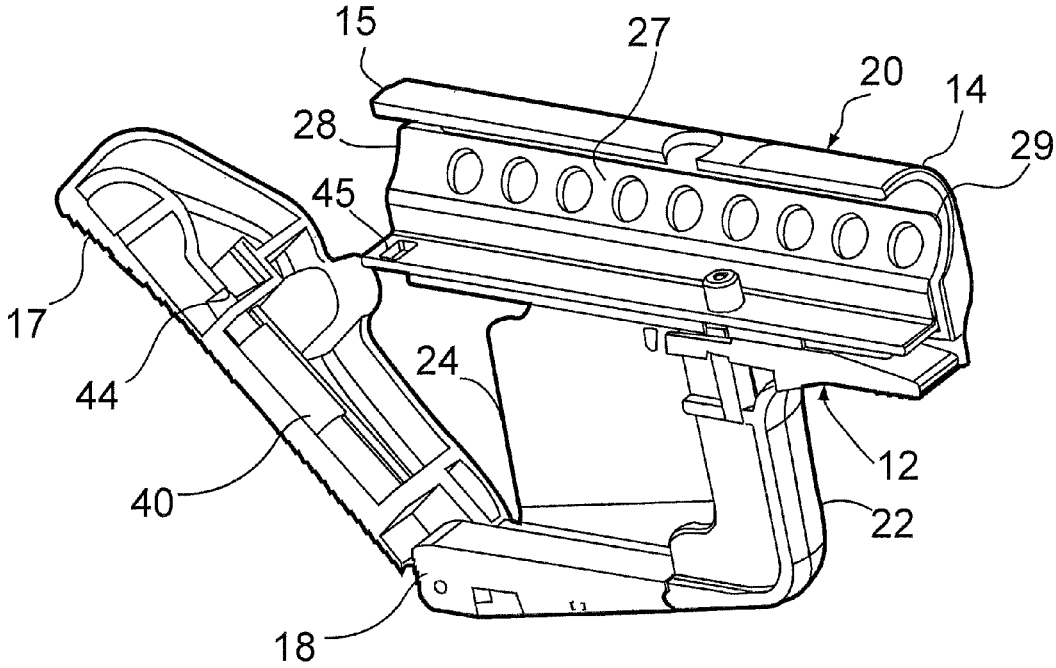
FIG. 5 is a sectional side view of the butt stock in the open position.

Turning now to FIGS. 3-5, it can be seen that housing 12 further includes an upper portion 20 and a lower portion 22 separated by a divider 23. Lower portion 22 is open at rearward end 15 and closed at forward end 14, providing a volume 24 (FIG. 2) which can be used as a convenient storage compartment for spare parts, cleaning implements and the like. Upper portion 20 is open at rearward end 15 and has an opening 25 at forward end 14. A spine reinforcing member 27 having a rearward end 28 and a forward end 29 is carried within upper portion 20 resting on divider 23 and extending from forward end 14 to rearward end 15. In order to provide the desired level of reinforcement, spine reinforcing member 27 is formed of a rigid and strong material such as metal. While steel or stainless steel provides the desired strength, to remain as light as possible, aluminum is preferred. As can be seen with specific reference to FIG. 4, with butt plate 17 in the closed position, rearward end 28 of spine reinforcing member 27 is in abutting engagement with butt plate 17. Reinforcing member 27 includes an aperture in a lower surface thereof for receipt of a pin 30 therethrough. Pin 30 is movable between a retracted position (level with the lower surface of reinforcing member 27) and an extended position (extending beyond the lower surface of reinforcing member 27 as seen in FIGS. 4 and 5) by a lever 32. Pin 30 is biased by a spring into the extended position through the aperture. This is an engagement mechanism for attaching a buffer tube of a firearm to the spine reinforcing member. In this manner, a reinforced pathway is established from the butt plate through the butt stock to the receiver of the firearm.

Still referring to FIG. 3, with additional reference to FIGS. 4 and 5, a spring action pin 40 biased into an extended position and moveable to a retracted position is carried by butt plate 17, anchored between flanges 42 and 43. Pin 40 includes an engagement end 44 received in a slot 45 formed in reinforcing member 27 in the extended position with butt plate 17 in the closed position (FIG. 4). Pin 40 further includes a tab 47 extending perpendicularly therefrom and spaced from end 44. Referring briefly back to FIG. 1, tab 47 extends through a slot in butt plate 17 providing access to tab 47 for moving pin 40 into the retracted position, withdrawing engagement end 44 from slot 45 and permitting movement of butt plate 17 to the open position.

Figure 6:
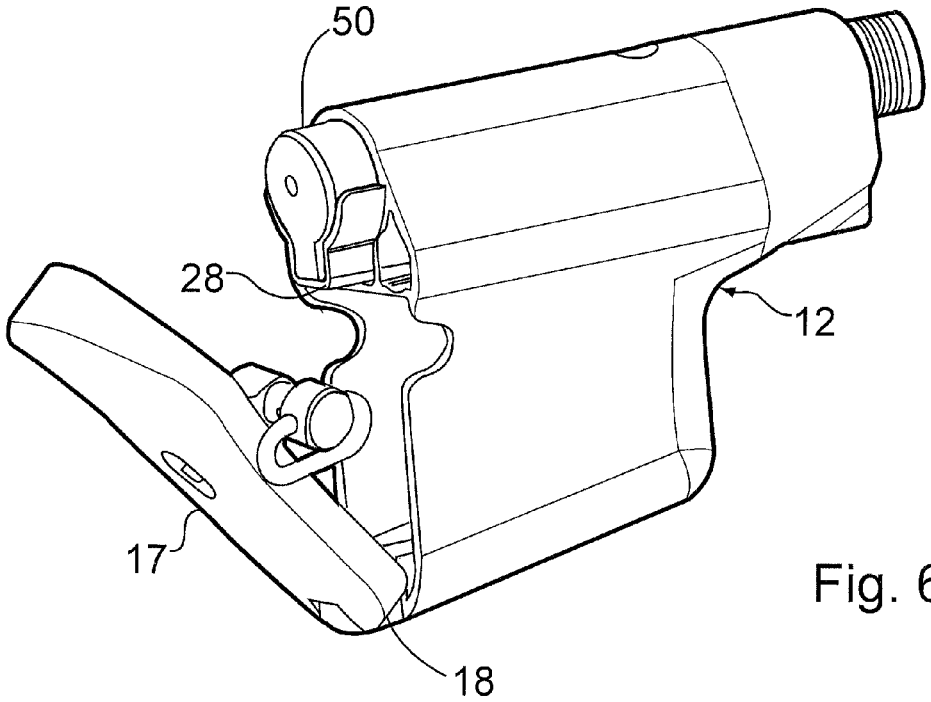
FIG. 6 is a perspective view of the butt stock of the present invention receiving and retaining a buffer tube of a firearm.
Figure 7:
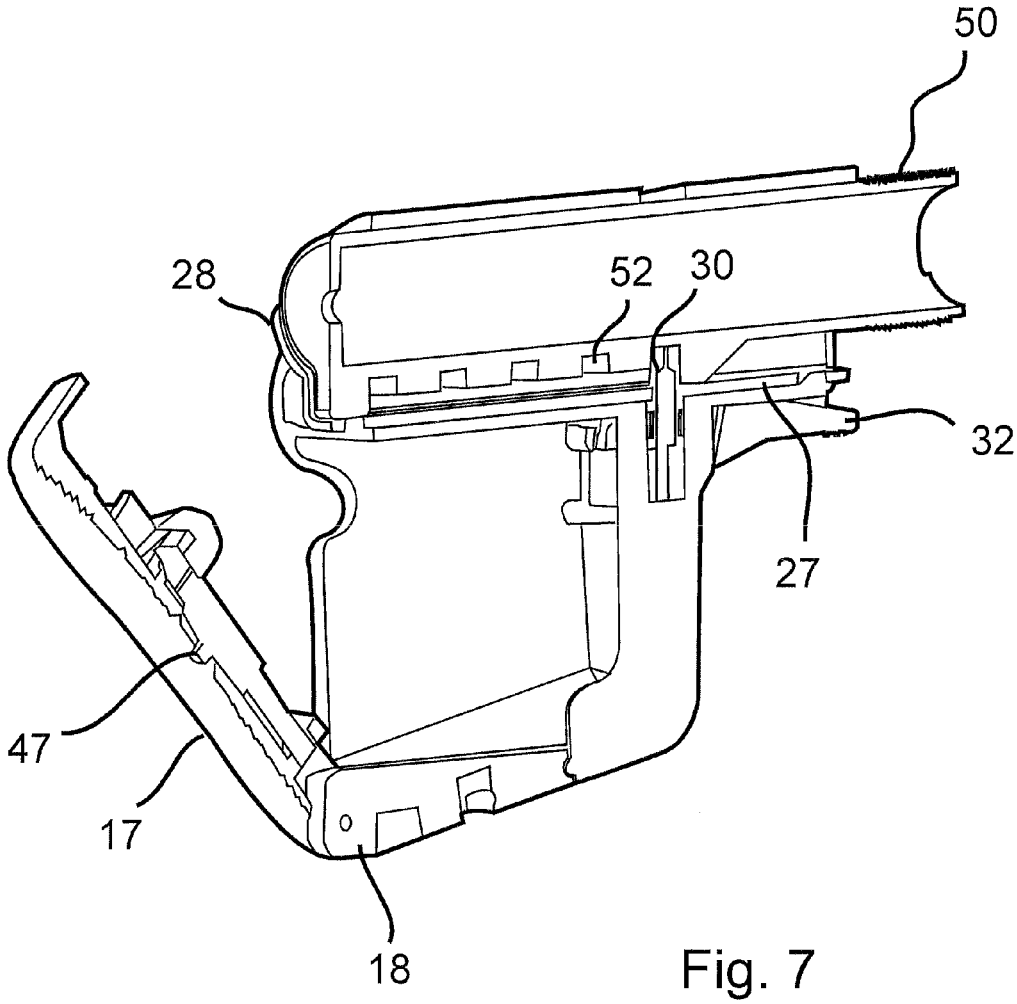
FIG. 7 is a sectional side view of the butt stock of FIG. 6.

Referring now to FIGS. 6 and 7, a buffer tube 50 is received through the opening of housing 12. Buffer tube 50 includes a series of notches 52 formed along the bottom thereof. Buffer tube 50 is reciprocally movable within upper portion of housing, cradled by reinforcing member. To extend or collapse butt stock 10, lever is pushed moving pin to the retracted position. This permits buffer tube 50 to be slidably moved within upper portion of housing unimpeded. When lever is release, pin is biased to the extended position and received in a corresponding one of notches 52, locking butt stock 10 in position relative buffer tube 50. In this manner, butt stock 10 can be extended further from or collapsed closer to the firearm. Regardless of the distance extended, butt plate 17 is directly coupled to the firearm through the metal to metal connection of the reinforcing member and the buffer tube. Thus substantially strength and rigidity is provided to allow the butt plate to be used as a striking tool.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. An extendable butt stock comprising:

a housing having a forward end, a rearward end, an upper portion being open at the forward end for receiving a buffer tube of a firearm therein and open at the rearward end, and a lower portion separated from the upper portion by a divider extending substantially from the rearward end to the forward end;

a spine reinforcing member, not being a part of the divider, having a rearward end and a forward end, the spine reinforcing member carried within the upper portion of the housing with the rearward end thereof extending beyond the open rearward end of the housing; and an engagement mechanism carried by the housing for attaching a buffer tube of a firearm to the spine reinforcing member.

2. An extendable butt stock as claimed in claim 1 wherein the engagement mechanism includes an aperture formed in a lower surface of the spine reinforcing member, and a pin extending therethrough and movable between a retracted position and an extended position.

3. An extendable butt stock as claimed in claim 2 wherein the engagement mechanism further includes a spring biasing the pin into the extended position and through the aperture.

4. An extendable butt stock as claimed in claim 1 further including:

the lower portion being open at the rearward end of the housing and closed at the forward end of the housing;

a butt plate; and a hinge plate pivotally attaching the butt plate to the rearward end of the housing, the butt plate movable between an open position and a closed position.

5. An extendable butt stock as claimed in claim 4 wherein the spine reinforcing member extends from the rearward end of the housing to proximate the forward end of the housing, with the butt plate contacting the rearward end of the spine reinforcing member when the butt plate is in the closed position.

6. An extendable butt stock comprising:

a housing having a forward end, an open rearward end, and an opening at the forward end for receiving a buffer tube of a firearm therethrough;

a butt plate;

a hinge plate pivotally attaching the butt plate to the rearward end of the housing, the butt plate movable between an open position and a closed position;

a spine reinforcing member, not being a part of the housing, having a rearward end and a forward end, the spine reinforcing member extending from the rearward end of the housing to proximate the forward end of the housing, wherein the butt plate contacts the rearward end of the spine reinforcing member when the butt plate is in the closed position; and an engagement mechanism carried by the housing for attaching a buffer tube of a firearm to the spine reinforcing member.

7. An extendable butt stock as claimed in claim 6 wherein the engagement mechanism includes an aperture formed in a lower surface of the spine reinforcing member, and a pin extending therethrough and movable between a retracted position and an extended position.

8. An extendable butt stock as claimed in claim 7 wherein the engagement mechanism further includes a spring biasing the pin into the extended position and through the aperture.

9. An extendable butt stock as claimed in claim 6 wherein the housing further includes an upper portion having the opening formed therein at the forward end of the housing for receiving a buffer tube of a firearm therein, and a lower portion separated from the upper portion by a divider extending substantially from the rearward end of the housing to the forward end of the housing.

10. An extendable butt stock comprising:

a housing having a forward end, an open rearward end, and an opening at the forward end;

a buffer tube of a firearm received through the opening in the housing;

a butt plate;

a hinge plate pivotally attaching the butt plate to the rearward end of the housing, the butt plate movable between an open position and a closed position;

a spine reinforcing member, not being a part of the housing, having a rearward end and a forward end, the spine reinforcing member extending from the rearward end of the housing to proximate the forward end of the housing and cradling the buffer tube, wherein the butt plate contacts the rearward end of the spine reinforcing member when the butt plate is in the closed position; and an engagement mechanism carried by the housing, releasably attaching the buffer tube to the spine reinforcing member.

11. An extendable butt stock as claimed in claim 10 wherein the engagement mechanism includes at least one notch formed in the buffer tube, an aperture formed in a lower surface of the spine reinforcing member, and a pin extending through the aperture to be received by the notch in an extended position and movable to a retracted position.

12. An extendable butt stock as claimed in claim 11 wherein the engagement mechanism further includes a spring biasing the pin into the extended position and through the aperture into the notch.

13. An extendable butt stock as claimed in claim 11 wherein the buffer tube is reciprocally movable through the opening of the housing with the pin in the retracted position and includes a plurality of notches for selectively receiving the pin in one of the plurality of notches in the extended position.

14. An extendable butt stock as claimed in claim 10 wherein the housing further includes an upper portion having the opening formed therein at the forward end of the housing for receiving a buffer tube of a firearm therein, and a lower portion separated from the upper portion by a divider extending substantially from the rearward end of the housing to the forward end of the housing.

* * * * *